US009044839B2

(12) United States Patent
Bharadwaj

(10) Patent No.: US 9,044,839 B2
(45) Date of Patent: Jun. 2, 2015

(54) METHOD FOR MEASURING MATERIAL REMOVAL DURING SURFACE FINISHING ON CURVED SURFACES

(71) Applicant: Shravan Bharadwaj, San Jose, CA (US)

(72) Inventor: Shravan Bharadwaj, San Jose, CA (US)

(73) Assignee: APPLE INC., Cupertino, CA (US)

( * ) Notice: Subject to any disclaimer, the term of this patent is extended or adjusted under 35 U.S.C. 154(b) by 269 days.

(21) Appl. No.: 13/627,998

(22) Filed: Sep. 26, 2012

(65) Prior Publication Data

US 2014/0087628 A1 Mar. 27, 2014

(51) Int. Cl.

| | |
|---|---|
| ***B24B 49/12*** | (2006.01) |
| ***B24B 49/00*** | (2012.01) |
| ***B24B 19/26*** | (2006.01) |
| ***B24B 27/00*** | (2006.01) |

(52) U.S. Cl.

CPC ..... *B24B 19/26* (2013.01); *B24B 27/0038* (2013.01); *B24B 49/12* (2013.01)

(58) Field of Classification Search

CPC ..... B24B 49/12; B24B 49/10; B24B 49/04; B24B 49/00; B24B 19/26; B24B 27/0038

USPC ..... 451/5, 6, 8, 9, 10, 28; 700/170, 164

See application file for complete search history.

(56) References Cited

U.S. PATENT DOCUMENTS

| | | | | |
|---|---|---|---|---|
| 5,077,941 | A * | 1/1992 | Whitney | 451/5 |
| 5,938,508 | A | 8/1999 | Canella et al. | |
| 7,014,531 | B2 | 3/2006 | Hansen | |
| 7,027,145 | B2 | 4/2006 | Segall et al. | |
| 7,147,541 | B2 | 12/2006 | Nagayama et al. | |
| 2004/0198024 | A1 | 10/2004 | Yoon et al. | |
| 2013/0065489 | A1 * | 3/2013 | Bultez et al. | 451/8 |

OTHER PUBLICATIONS

U.S. Appl. No. 13/531,561, filed Jun. 24, 2012.
U.S. Appl. No. 13/531,562, filed Jun. 24, 2012.

* cited by examiner

*Primary Examiner* — Robert Rose
(74) *Attorney, Agent, or Firm* — Downey Brand LLP

(57) ABSTRACT

The described embodiment relates generally to the development of a finishing process for a device housing. The device housing can be formed of a thermoplastic, or a metal such as aluminum or stainless steel. A method and an apparatus are described for accurately measuring the amount of material removed during a finishing process. More particularly embodiments described within this application disclose a method of accurately measuring material removal during a finishing process across a curved or spline shaped surface by drilling an array of pockets along a surface of the device housing, where the drilled pockets can be used to measure material removal rates with a high degree of accuracy.

21 Claims, 8 Drawing Sheets

METHOD FOR MEASURING MATERIAL REMOVAL DURING SURFACE FINISHING ON CURVED SURFACES

BACKGROUND

1. Technical Field

The described embodiment relates generally to refining polishing operations for cosmetic surfaces of a three dimensional object having cosmetic curved surfaces. More particularly, a method and an apparatus are described for accurately removing material from a curved, cosmetic surface of a housing during a polishing operation.

2. Related Art

Fine surface finishing operations such as sanding and polishing remove material on the order of a few to several hundred microns depending on the intensity and cycles of force application. On three-dimensional surfaces composed of splines or curvatures, it is challenging to measure material removal and directly correlate it to accuracy and efficiency of the finishing operation. During modern machining operations, the finishing tool is generally perpendicular to the curvature of the workpiece whereas historically, measurement methods have been made perpendicular to a plane of reference. This conformal tool orientation results in parallax. Both contact and non-contact measurement methods such as lasers, 3D scanners, CMMs, OMMs, etc. have been deployed in various applications. These methods requires fixed datum as reference with respect to which material removed in the vertical direction compared before and after finishing. Given that the material removed is incredibly small, fixed datums of reference yield a significant measurement error.

Thus there exists a need for a method and an apparatus for polishing a three dimensional curved edge of an object resulting in a visually smooth and consistent reflective appearance.

SUMMARY

This paper describes many embodiments that relate to a system, method and computer readable medium for enabling precise material removal as part of a finishing process.

In a first embodiment a machining process calibration system for a workpiece is disclosed. The machining process calibration system includes at least the following: (1) a robotic arm having at least five degrees of freedom and configured to follow a tool control path that maintains the robotic arm in an orientation substantially normal to a surface of the workpiece; (2) a drilling tool mechanically coupled to the robotic arm during a drilling operation in which a number of pockets are drilled into the workpiece at an angle substantially normal to the surface of the workpiece; (3) a finishing tool mechanically coupled to the robotic arm during a finishing operation; and (4) a depth measurement tool configured to measure the depth of the pockets before and after the finishing operation. A differential between the measured depth of the pockets before and after the finishing operation is used to determine material removed across each of the drilled pockets.

In another embodiment a method for calibrating a finishing operation for a spline-shaped housing is disclosed. The spline shaped housing has a varying radius of curvature. The method includes at least the following steps: (1) drilling a number of pockets into and substantially normal to a surface of a calibration housing having dimensions in accordance with the spline-shaped housing, where the pockets have a depth deeper than a pre-defined material removal depth for a production style housing; (2) measuring a pre finishing depth of the drilled plurality of pockets; (3) finishing the surface of the test housing including the pockets with a finishing tool; (4) measuring a post finishing depth of the pockets; and (5) continuing to polish the surface of the test housing until the measured post finishing depth of a pre-defined number of the pockets is determined to be in compliance with the pre-defined material removal depth.

In yet another embodiment a non-transient computer readable medium for calibrating a finishing operation for a workpiece is disclosed. The non-transient computer readable medium includes at least the following: (1) computer code for receiving a pre-defined indication of a material removal depth for the workpiece; (2) computer code for forming a number of pockets into and substantially normal to an exterior surface of the workpiece; (3) computer code for measuring a pre-finishing depth of at least one of the pockets; (4) computer code for finishing the surface of the workpiece subsequent to the measuring of the pre-finishing depth; (5) computer code for measuring a post-finishing depth of the previously measured pockets; (6) computer code for determining an amount of material removed from the workpiece by comparing the pre-finishing and post-finishing measured depths; and (7) computer code for continuing to polish the surface of the workpiece until the determined material removal of a predetermined number of the pockets is determined to be in compliance with the pre-defined material removal depth.

BRIEF DESCRIPTION OF THE DRAWINGS

The embodiments will be readily understood by the following detailed description in conjunction with the accompanying drawings, wherein like reference numerals designate like structural elements, and in which.

DETAILED DESCRIPTION OF EXAMPLE EMBODIMENTS

Figure 1A:
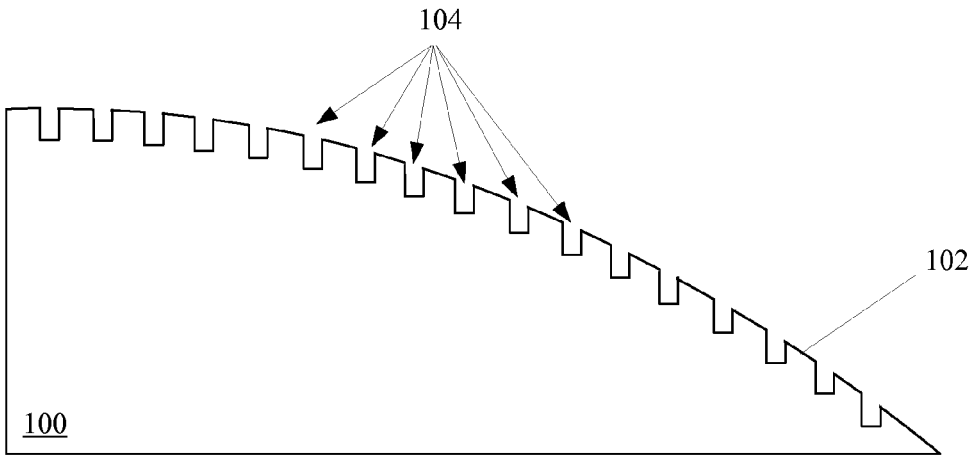
FIG. 1A (related art)
FIGS. 1A-1B illustrate a parallax effect resulting from pockets being drilled vertically into a spline shaped housing.

The described embodiments relate generally to the polishing of a three dimensional curved surface of an object. More particularly, a method and an apparatus are described for polishing the surface of the object, formed using either an injection molded thermoplastic compound, or a metal such as aluminum or stainless steel. In some embodiments the object can have a visually smooth and consistent reflective appearance.

In the following description, numerous specific details are set forth to provide a thorough understanding of the present invention. It will be apparent, however, to one skilled in the art that the present invention may be practiced without some or all of these specific details. In other instances, well known process steps have not been described in detail in order to avoid unnecessarily obscuring the present invention.

Manufacturing processes for producing consumer electronic devices often involve a polishing step to imbue the device with a pleasing overall look and feel. These polishing steps can be applied to numerous types of materials such as for example, aluminum, stainless steel, and injection molded thermoplastics with various geometrically shaped surfaces. Unfortunately, polishing pads and especially soft polishing pads are notoriously difficult to control, particularly when they are applied to curved surfaces. Poorly controlled polishing operations can result in large sample variations causing high rates of component rejection. These types of variations can cause even higher rejection rates when components have a mirror-like or highly reflective surface as even small surface variations can be noticeable. This controllability difficulty makes the determination of the amount of polishing to conduct during a polishing step problematic at best. Furthermore, although three dimensional scanning techniques are generally available, discrimination of differences between machining operations is only accurate to about 20 microns. When attempting to refine a model process to be implemented on other machining devices accuracy is paramount. One way to refine polishing operations and achieve removal of a precise amount of material is to drill pockets of known size, depth, and orientation into the surface of the material to be polished. The pockets can be drilled by a number of different tools including mechanical and laser drills.

In one embodiment an array of pockets can be used to calibrate a polishing process in a set of destructive tests. The polishing process can be adapted to achieve a particular finish, and/or remove shallow defects. For example, if 95% of a particular production part tends to have scratches of no greater than 30 microns, then by adapting the polishing process to remove a 30 micron deep layer of material from all surfaces of the part, a desired finish and removal of defects can be achieved. Unfortunately, material removal rates for polishing pads can be hard to predict, and particularly difficult around curved surfaces or corners. However, once a process is established high levels of predictability can be achieved. One way to establish such a process is to drill pockets into a workpiece at depths deeper than the targeted surface depth. A depth greater than a targeted surface depth helps to prevent pockets from being polished away during testing. Each pocket can be drilled at a known size, depth and orientation. Machining tolerances of the drill used can be substantially overcome by subsequent to the drilling of the pockets measuring the depth of each drilled pocket. In this way a known point cloud of pockets can be recorded. Subsequent, measurements of the numerous pockets can be accomplished by the same set of measuring tools. In this way a highly accurate differential measurement can be obtained after each set of polishing operations. A delta function can then be used to determine actual amounts of material removed from each portion of the workpiece. In one specific embodiment a finishing tool can have a depth measurement tool coupled to it. The depth measurement tool can be a laser interferometer configured to measure a change in depth of pockets just subsequent to a polishing operation. In this way feedback is provided in a near real-time manner allowing rapid determination of finishing performance.

A number of these destructive tests can be conducted before a refined process is achieved. Since polishing pads can wear out quickly even after the process has been refined as part of the initial process development, a manufacturer may need to run destructive tests periodically, sometimes referred to as process drift measurements in order to ensure the installed set of pads are performing predictably. Depending on the component tolerances and polishing pad durability this can be something that would need to be accomplished with more or less frequency. Such subsequent destructive testing would essentially amount to a calibration test to ensure the pads are performing predictably.

These and other embodiments are discussed below with reference to FIGS. 1-7; however, those skilled in the art will readily appreciate that the detailed description given herein with respect to these figures is for explanatory purposes only and should not be construed as limiting.

Figure 1B:
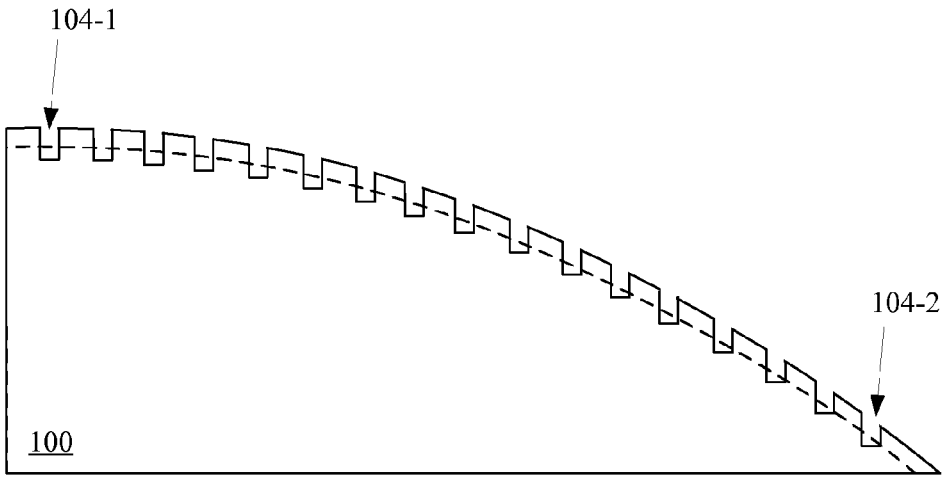
FIG. 1B (related art)

In FIG. 1A a housing 100 having a spline shaped surface 102 is shown. Although an example of a housing is used in this paper this process can be applied to any component having curved or spline shaped surfaces undergoing a finishing operation. Consequently use of the term housing should not result in any loss of generality to the application of described embodiments contained in this paper. A spline shaped surface is a curved, non-parametric surface. In the case of the illustrated figure the spline shaped surface has a varying curvature. Due to the nature of non-parametric surfaces, drilling of holes normal to surface 102 can be quite challenging to define. A traditional computer numerical control (CNC) machine would generally drill pockets 104 vertically into housing 100 as depicted. Such a technique introduces parallax errors into material measurement determinations. In FIG. 1B a dotted line representing a uniform removal of material from housing 100 by a finishing process is displayed. While such a method of drilling might work acceptably for pocket 104-1, arranged in a substantially horizontal surface, it works quite poorly for pocket 104-2. Pocket 104-1 accurately shows about half of the depth of the pocket removed while in the case of pocket 104-2 almost all of one side of pocket 104-2 is removed.

Figure 2A:
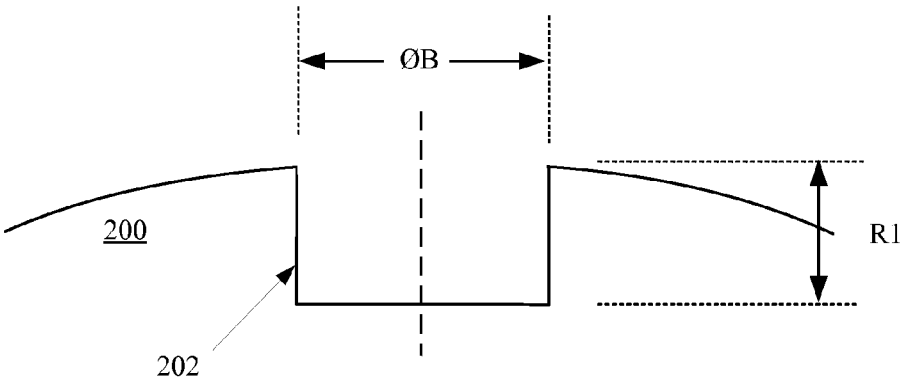
FIG. 2A shows a pocket drilled normal to a surface of housing.
Figure 2B:
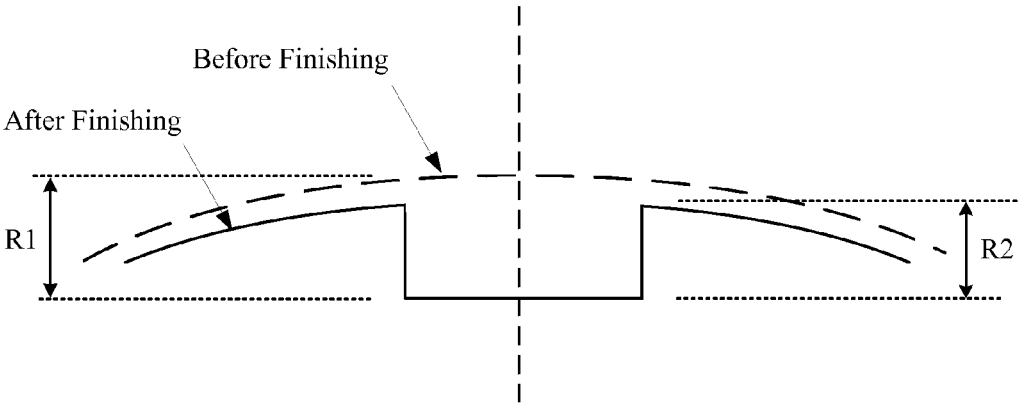
FIG. 2B shows a cross-sectional side view of a housing with a pocket drilled normal to a surface of the housing and how an amount of surface material removed can be measured when that material is removed above a pocket drilled into the surface of a housing.

FIG. 2A shows pockets drilled perpendicular to a surface of housing 200. Perpendicularly drilled pockets can accurately track material removal since contact patches (portions of the workpiece in contact with the finishing tool) associated with finishing tools are generally oriented normal to a surface of housing 200 when conducting a finishing operation. Pocket 202 can have a depth R1 measured in relation to a vector normal to a surface of housing 200. Depth R1 can be drilled a depth greater than an expected material removal amount from housing 200. In FIG. 2B before and after finishing surfaces show how a material removal depth can be determined by measuring initial depth R1 against post finishing operation depth R2, providing a highly accurate reading on material removal for a given position on the surface of housing 200. When considered in a three dimensional set of coordinates material removal can be determined by the following equation:

$$M(x,y,z)=R1(x,y,z)-R2(x,y,z) \quad \text{Eq 1}$$

Figure 2C:
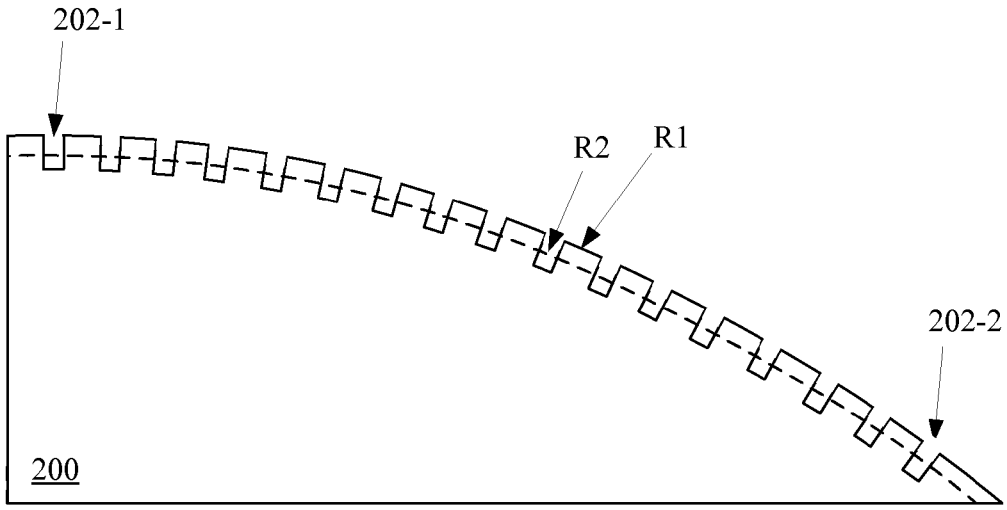
FIG. 2C shows a cross-sectional side view of a housing with a number of pockets drilled into it normal to a spline shaped portion of the housing.

In FIG. 2C an array of pockets arranged along a curved surface is shown. As illustrated pocket 202-1 and pocket 202-2 are now clearly showing an equal material removal amount, thereby correctly corresponding to actual material removal. While pockets 202 are shown evenly spaced across the surface of housing 200 in certain embodiments spacing of pockets 202 can be variable. In some cases spacing variability can be determined in accordance with surface complexity of housing 200. For example, a flat portion of housing 200 can have a substantially smaller density of pockets 202 than curved or spline shaped surfaces of housing 202. It should be noted that an area of material removed above pocket 202 can be determined in accordance with Eq. 2 below by taking the integral around the entire pocket (0 to $2\pi$). Once area is determined in conjunction with a corresponding depth of material removed in accordance with Eq. 1 a total volume of material removed above pocket 202 can be determined.

$$A(x,y,z)=\int R1(x,y,z)d\varnothing-\int R2(x,y,z)d\varnothing \quad \text{Eq 2:}$$

Figure 3:
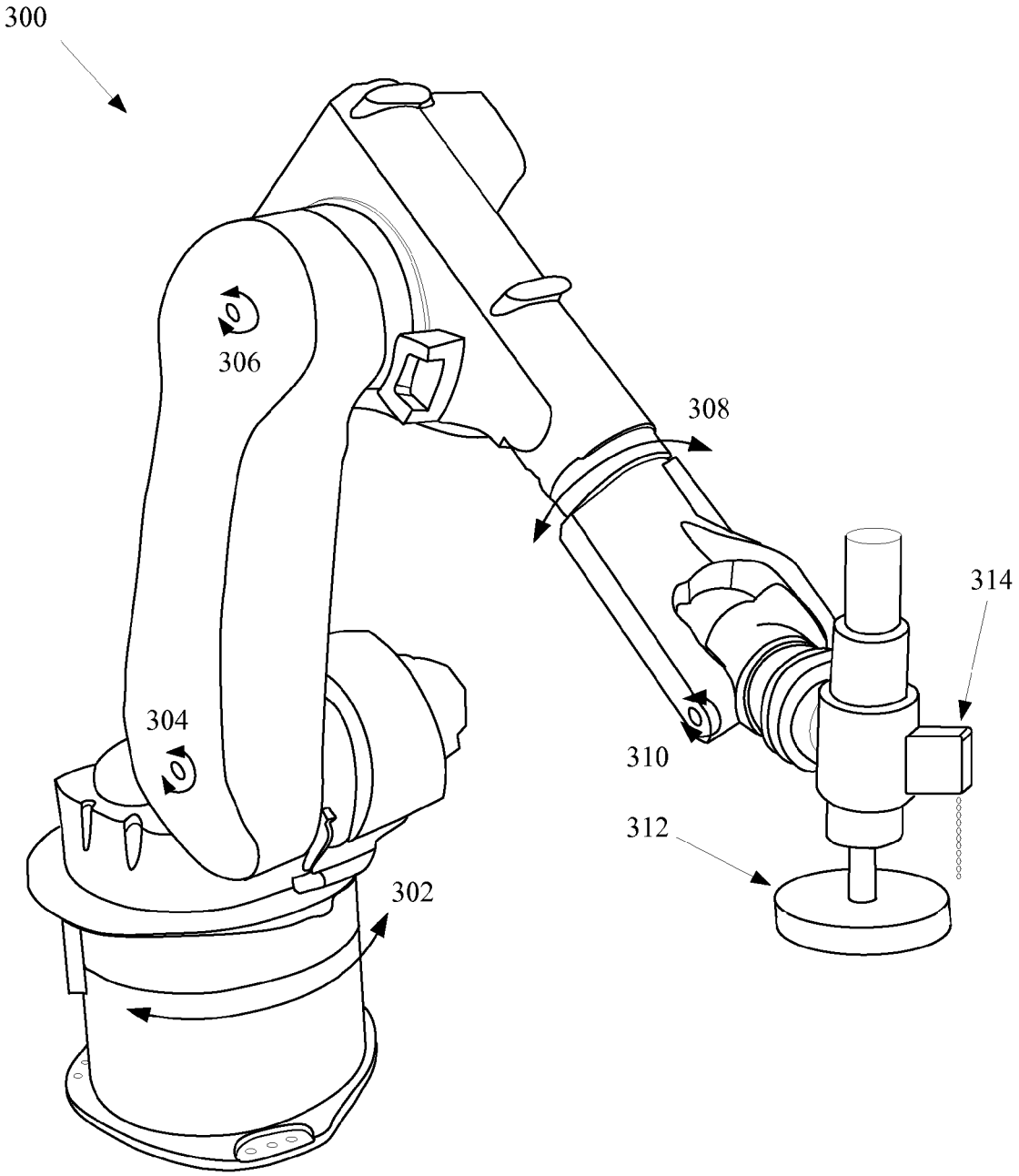
FIG. 3 shows a perspective view of a five axis robotic arm that can be used in conjunction with described example embodiments.

In FIG. 3 a five axis robotic arm 300 is shown. While FIGS. 2A-2C show advantages associated with pockets drilled normal to a surface of housing 200 the accompanying explanation does not explain how accurate holes can be thus oriented. A five axis robotic arm such as the one depicted in FIG. 3 can be configured to accurately maneuver a finishing tool along a surface of a housing. This maneuvering can be referred to as a tool control path. A tool control path can be accurate to a tolerance of about 5 microns and moves the finishing device in an orientation that is substantially normal to the surface of the housing. By using the tool control path with a similar robotic arm 300 to drill pockets in the housing, holes can be drilled to an accuracy of about 5 microns. Since the tool control path is already designed to orient a machining tool in an orientation normal to the surface, minimal reconfiguration can be required for drilling the pockets. A tolerance of 5 microns can create a much tighter machining profile than one created by a three dimensional surface scanner, where tolerance of the three dimensional scanner is only 20 microns. Furthermore, when machining more housings made of more ductile material such as for example aluminum, handling of the part itself can result in minute modification of the orientation of the surface by slight deformation of the housing. Consequently the finishing calibration process should be completed without moving the part.

As configured robotic arm 300 can be maneuvered in at least axes 302, 304, 306, 308 and 310. In this way finishing tool 312 can be maneuvered along a surface of a spline shaped workpiece. Also depicted in FIG. 3 is depth measurement tool 314. Depth measurement 314 can be a laser configured to measure a depth of pockets subsequent to a polishing operation. In some cases the laser can be maneuverable to focus on pockets arranged in various locations with respect to finishing tool 312. By coupling laser depth measurement tool 314 and finishing tool 312 an additional measuring step can be removed from the process. It should be noted that in some embodiments a laser can be configured both in front of and behind the finishing tool in order to allow real-time determination of material depth removal during a finishing process.

Figure 4:
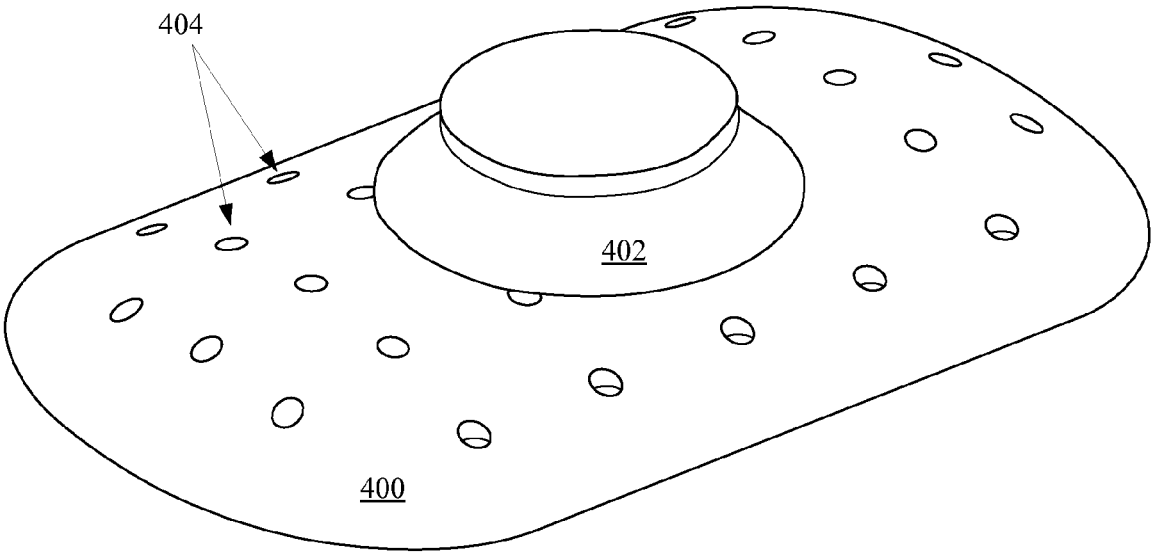
FIG. 4 shows a perspective view of a spline shaped housing with a number of pockets drilled into it.

FIG. 4 illustrates a spline shaped housing 400 undergoing a finishing operation by finishing tool 402. In one embodiment finishing tool 402 can be a sanding tool. Spline shaped housing 400 can have a number of pockets 404 drilled into it. Pockets 404 can be drilled into housing 400 in the same manner described in the above text associated with FIG. 2. In FIG. 4, finishing tool 402 can pass simultaneously over at least portions of multiple pockets 404. In such a case laser depth measurement tool 312 (not shown) would need to be configured to monitor relative depth across multiple pockets in multiple locations with respect to finishing tool 402. When data retrieved from this material removal determines that additional pressure or abrasive action is needed in certain areas, a force feedback component can be configured with the robotic arm to allow precise application of force to establish an accurate force profile for the finishing operation.

Figure 5:
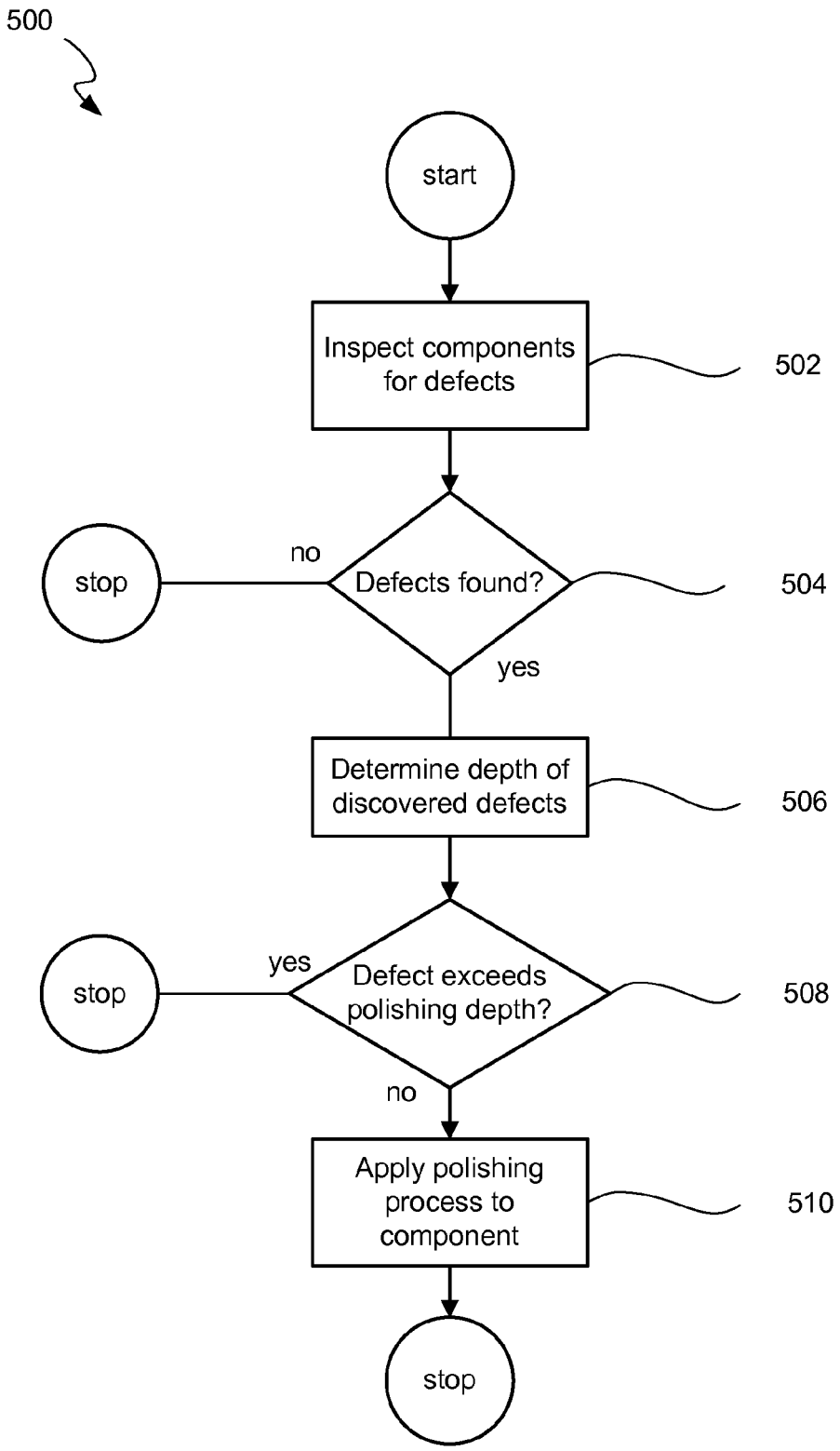
FIG. 5 shows a block diagram of a process for choosing candidate components for a configured finishing operation.

FIG. 5 shows a block diagram of a process for choosing candidate components for a configured finishing operation. The finishing process can be applied for a number of scenarios. One such scenario is a refinishing operation, where scratches in a housing are eliminated. If surface characteristics of that housing substantially prevent scratches from exceeding a certain threshold then a polishing profile can be configured to evenly remove for example 30 microns from all surfaces of a part. Where a thin and even layer of material is removed across the housing the re-polished component can be indistinguishable from a component straight off of a production line. Components that exceed a value of 30 microns can be candidates for rework or reformation. In a first step 502 of the finishing process components are inspected for defects. Component inspection can be conducted manually or more frequently by a computer automated scanning process. At step 504 if no defect is found or a discovered set of defects are considered small enough they don't detract from aesthetic or functional aspects of the component then the process ends. Such a component with no discovered defects may still be a candidate for a refinishing process where less material is removed from the component. Otherwise at step 506 a more thorough scan can be conducted more fully characterizing the identified defect. The more thorough scan can be accomplished by for example a laser interferometer, determining with precision how deep into the surface the defect extends. At step 508 if the depth with respect to the surface of the part exceeds a material removal portion of the associated polishing process the process ends. Otherwise at step 510 the polishing process is applied to the component, thereby removing the detected defects and applying a new surface finish to the component.

Figure 6:
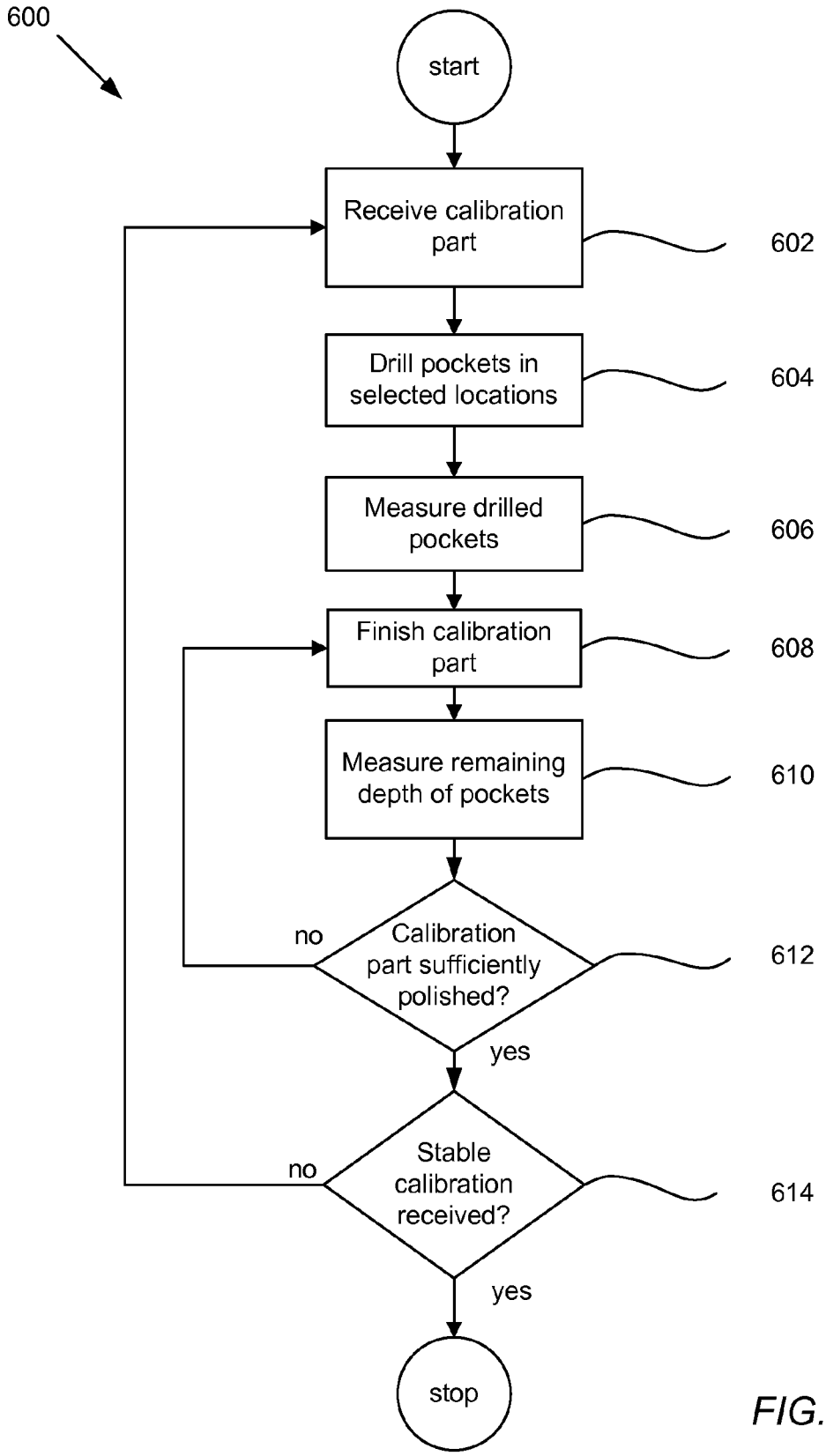
FIG. 6 shows a block diagram of a process for calibrating a finishing process.

FIG. 6 shows a block diagram of a process 600 for calibrating a finishing operation. In step 602 a calibration part is received. The calibration part is a part configured to be as close as possible to production parts that will be subject to the calibrated finishing process. In step 604 a number of pockets are drilled in select locations of the calibration part. The number of pockets drilled can be dependent upon the level of fidelity needed in each portion of the calibration part. For example a flat portion can be configured with only a few pockets while a curved or spline shaped surface can have tightly space pockets allowing for precise determination of material removal. Tightly spaced pockets can be even more crucial when significant changes in geometry are made to certain portions of the calibration part. In one embodiment a calibration part can have ball milled features caused by a preceding machining process. In such an eventuality material rates can be especially difficult to determine.

In step 606 the drilled pockets can be measured. This initial measurement gives the measuring instrument a baseline measurement of pocket depth and orientation. In this way any inaccuracy in drilled pocket depth of orientation can be substantially ameliorated. In step 608 a finishing operation can be applied to the calibration part. In one embodiment each portion of the calibration part can be finished about one time. In step 610 a remaining depth of each finished pocket can be measured. In situations where a pocket is finished multiple times due to overlapping passes of the finishing tool a material depth can be checked after each pass. One way to accomplish such a measurement is to mechanically couple a measurement instrument to the finishing tool. In this way pockets can be measured almost immediately after a finishing pass is applied. In step 612 measurement data is analyzed and compared to both initial depth measurement figures and desired depth measurement figures. The desired depth measurement figures can be embodied by a desired finished geometry corresponding to the desired depth measurements. If the most current set of depth measurement figures have not met the desired depth measurements then another finishing operation 608 is conducted. If the calibration part does meet the desired depth measurements then a determination at 614 is made. In step 614 it is determined whether or not a stable calibration has been received as a result of measurements taken during the finishing operations. A stable calibration can require multiple calibration parts to be finished before an acceptable calibration is reached. A stable calibration can be reached when successful results from one polished calibration part are verified by a polishing operation applied subsequently to another calibration part. In some embodiments various computer simulation steps can be taken prior to the described experimental part calibrations so that a closer finishing operation can be input prior to physical testing. Generally the calibration development is iterative arriving at a solution only after many calibrations in which pressure, abrasive action and finishing tool paths are tried and experimented with. Once an acceptable solution is reached the process stops.

Figure 7:
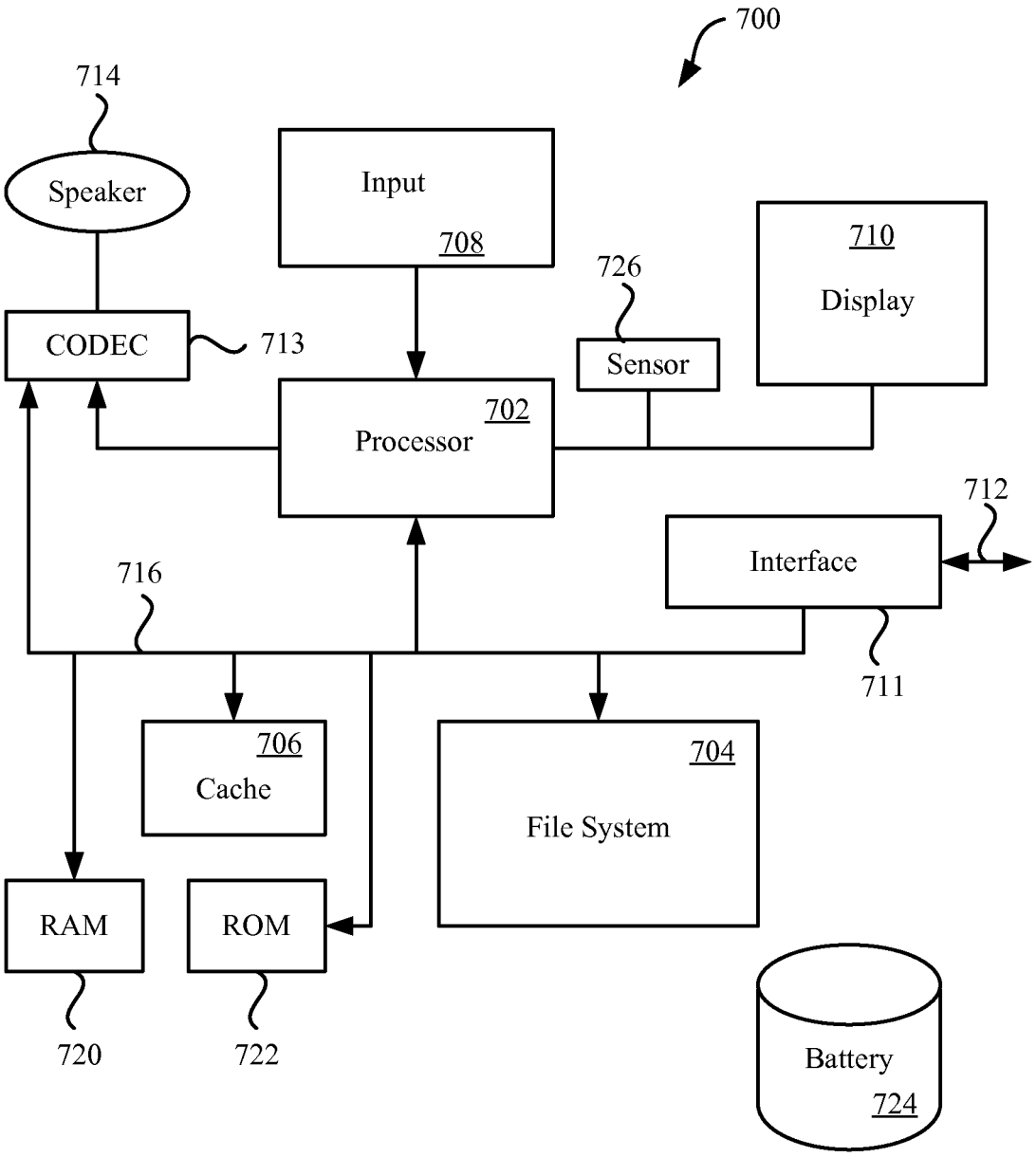
FIG. 7 is a block diagram of electronic device 700 suitable for use while calibrating a finishing calibration process.

FIG. 7 is a block diagram of electronic device 700 suitable for use while calibrating a finishing operation in accordance with the example embodiments. Electronic device 700 illustrates circuitry of a representative computing device. Electronic device 700 includes a processor 702 that pertains to a microprocessor or controller for controlling the overall operation of electronic device 700. Electronic device 700 contains instruction data pertaining to manufacturing instructions in a file system 704 and a cache 706. The file system 704 is, typically, a storage disk or a plurality of disks. The file system 704 typically provides high capacity storage capability for the electronic device 700. However, since the access time to the file system 704 is relatively slow, the electronic device 700 can also include a cache 706. The cache 706 is, for example, Random-Access Memory (RAM) provided by semiconductor memory. The relative access time to the cache 706 is substantially shorter than for the file system 704. However, the cache 706 does not have the large storage capacity of the file system 704. Further, the file system 704, when active, consumes more power than does the cache 706. The power consumption is often a concern when the electronic device 700 is a portable device that is powered by a battery 724. The electronic device 700 can also include a RAM 720 and a Read-Only Memory (ROM) 722. The ROM 722 can store programs, utilities or processes to be executed in a non-volatile manner. The RAM 720 provides volatile data storage, such as for cache 706.

The electronic device 700 also includes a user input device 708 that allows a user of the electronic device 700 to interact with the electronic device 700. For example, the user input device 708 can take a variety of forms, such as a button, keypad, dial, touch screen, audio input interface, visual/image capture input interface, input in the form of sensor data, etc. Still further, the electronic device 700 includes a display 710 (screen display) that can be controlled by the processor 702 to display information to the user. A data bus 716 can facilitate data transfer between at least the file system 704, the cache 706, the processor 702, and a CODEC 713. The CODEC 713 can be used to decode and play a plurality of media items from file system 704 that can correspond to certain activities taking place during a particular manufacturing process. The processor 702, upon a certain manufacturing event occurring, supplies the media data (e.g., audio file) for the particular media item to a coder/decoder (CODEC) 713. The CODEC 713 then produces analog output signals for a speaker 714. The speaker 714 can be a speaker internal to the electronic device 700 or external to the electronic device 700. For example, headphones or earphones that connect to the electronic device 700 would be considered an external speaker.

The electronic device 700 also includes a network/bus interface 711 that couples to a data link 712. The data link 712 allows the electronic device 700 to couple to a host computer or to accessory devices. The data link 712 can be provided over a wired connection or a wireless connection. In the case of a wireless connection, the network/bus interface 711 can include a wireless transceiver. The media items (media assets) can pertain to one or more different types of media content. In one embodiment, the media items are audio tracks (e.g., songs, audio books, and podcasts). In another embodiment, the media items are images (e.g., photos). However, in other embodiments, the media items can be any combination of audio, graphical or visual content. Sensor 726 can take the form of circuitry for detecting any number of stimuli. For example, sensor 726 can include any number of sensors for monitoring a manufacturing operation such as for example a Hall Effect sensor responsive to external magnetic field, an audio sensor, a light sensor such as a photometer, a depth measurement device such as a laser interferometer and so on.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable medium for controlling manufacturing operations or as computer readable code on a computer readable medium for controlling a manufacturing line used to fabricate computer components such as computer housing formed of metal or plastic. The computer readable medium is any data storage device that can store data which can thereafter be read by a computer system. Examples of the computer readable medium include read-only memory, random-access memory, CD-ROMs, DVDs, magnetic tape, optical data storage devices, and carrier waves. The computer readable medium can also be distributed over network-coupled computer systems so that the computer readable code is stored and executed in a distributed fashion.

The foregoing description, for purposes of explanation, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description. They are not intended to be exhaustive or to limit the invention to the precise forms disclosed. It will be apparent to one of ordinary skill in the art that many modifications and variations are possible in view of the above teachings.

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A machining process calibration system for a workpiece, comprising:

a robotic arm having at least five degrees of freedom and configured to follow a tool control path that maintains the robotic arm in an orientation substantially normal to a surface of the workpiece;

a pocket forming tool mechanically coupled to the robotic arm during a pocket forming operation in which a plurality of pockets are formed in the workpiece at an angle substantially normal to the surface of the workpiece;

a finishing tool mechanically coupled to the robotic arm during a finishing operation; and a depth measurement tool configured to measure a depth of the plurality of pockets before and after the finishing operation, wherein a differential between a measured depth of the plurality of pockets before the finishing operation and a measured depth of the plurality of pockets after the finishing operation is used to determine material removed across each of the plurality of pockets.

2. The machining process calibration system as recited in claim 1, further comprising:

a datum having a pre-defined geometry of the workpiece, the datum configured to determine when particular portions of the workpiece have achieved a pre-defined geometry during a finishing operation.

3. The machining process calibration system as recited in claim 2, wherein the pocket forming tool is configured to form the plurality of pockets deeper into the workpiece than the datum, thereby allowing material removal depth determination when finishing operations remove more material than defined by the datum.

4. The machining process calibration system as recited in claim 3, wherein the surface of the workpiece has at least one spline shaped portion.

5. The machining process calibration system as recited in claim 4, wherein the plurality of pockets are more densely arranged across the at least one spline shaped portion of the surface of the workpiece than flat portions of the surface of the workpiece.

6. The machining process calibration system as recited in claim 5, wherein the depth measurement tool is a laser interferometer mechanically coupled to the robotic arm during the finishing operation such that material depth removal from each of the plurality of pockets is measured after the finishing tool passes over each of the plurality of pockets.

7. The machining process calibration system as recited in claim 6, wherein the forming tool is a laser drill.

8. The machining process calibration system as recited in claim 5, further comprising:

a force feedback sensor configured to regulate an amount of force applied to the workpiece during the finishing operation.

9. A method for calibrating a finishing operation for a spline shaped housing, the spline shaped housing having a varying radius of curvature, comprising:

forming a plurality of pockets into and substantially normal to a surface of a calibration housing having dimensions in accordance with the spline shaped housing using a robotic arm configured to follow a tool control path that maintains the robotic arm in an orientation substantially normal to the surface of the calibration housing, the plurality of pockets having a depth deeper than a predefined material removal depth for a production style housing;

measuring a pre finishing depth of the drilled plurality of pockets;

finishing the surface of the calibration housing including the plurality of pockets with a finishing tool;

measuring a post finishing depth of the plurality of pockets; and continuing to polish the surface of the calibration housing until the measured post finishing depth of a predefined number of the plurality of pockets is determined to be in compliance with the predefined material removal depth.

10. The method as recited in claim 9, further comprising:

determining whether a stable calibration of the finishing operation has been reached subsequent to completion of polishing operations on the calibration housing; and repeating the method with another calibration housing if a stable calibration of the finishing operation has not been reached.

11. The method as recited in claim 10, wherein a stable calibration is reached when the plurality of pockets of consecutive calibration housings are each in compliance with the predefined material removal depth.

12. The method as recited in claim 11, wherein measurement of the drilled plurality of pockets is accomplished by a first and second laser interferometer mechanically coupled to the finishing tool, the first laser interferometer configured to measure the drilled plurality of pockets before a finishing operation and the second laser interferometer configured to measure the drilled plurality of pocked after a finishing operation.

13. The method as recited in claim 11, wherein measuring the pre finishing depth and measuring the post finishing depth provide first and second point cloud representations of the surface of the spline shaped housing.

14. The method as recited in claim 13, further comprising:

using a delta function to determine material removal across the surface of the spline shaped housing between the first and second point cloud representations.

15. The method as recited in claim 11, further comprising:

periodically recalibrating the finishing operation at a predefined interval to validate performance of the calibrated finishing operation.

16. A non-transient computer readable medium for calibrating a finishing operation for a workpiece, comprising:

computer code for receiving a pre-defined material removal depth for the workpiece;

computer code for forming a plurality of pockets into and substantially normal to an exterior surface of the workpiece;

computer code for measuring a pre-finishing depth of at least one of the plurality of pockets;

computer code for finishing the surface of the workpiece subsequent to the measuring of the pre-finishing depth;

computer code for measuring a post-finishing depth of the previously measured at least one of the plurality of pockets;

computer code for determining an amount of material removed from the workpiece by comparing the pre-finishing depth and the post-finishing depth; and computer code for continuing to polish the surface of the workpiece until the amount of material removed is in compliance with the pre-defined material removal depth.

17. The non-transient computer readable medium as recited in claim 16, wherein the pre-defined material removal depth is substantially uniform across the surface of the workpiece.

18. The non-transient computer readable medium as recited in claim 17, further comprising:

computer code for repeating the calibration method when an amount of material removed across all of the plurality of pockets is not in compliance with the pre-defined material removal depth.

19. The non-transient computer readable medium as recited in claim 18, wherein the plurality of pockets are formed at a depth greater than the pre-defined material removal depth, thereby allowing material removal depth measurements to be made throughout a calibration process.

20. The non-transient computer readable medium as recited in claim 19, wherein the pre-determined material removal depth removes defects from at least a majority of production style workpieces that the finishing operation is configured to be applied to.

21. A method for calibrating a finishing operation for a spline shaped housing, the spline shaped housing having a varying radius of curvature, comprising:

forming pockets into and substantially normal to a surface of a calibration housing having dimensions in accordance with the spline shaped housing, the pockets having a depth deeper than a predefined material removal depth for a production style housing;

measuring a pre finishing depth of the pockets using a first laser interferometer mechanically coupled to a finishing tool;

finishing the surface of the calibration housing including the pockets with a finishing tool;

measuring a post finishing depth of the pockets using a second laser interferometer mechanically coupled to the finishing tool; and continuing to polish the surface of the calibration housing until the measured post finishing depth of a predefined number of the pockets is determined to be in compliance with the predefined material removal depth.

* * * * *